US008613987B2

(12) United States Patent
Nakano et al.

(10) Patent No.: US 8,613,987 B2
(45) Date of Patent: Dec. 24, 2013

(54) INK-JET RECORDING MEDIUM

(75) Inventors: Ryoichi Nakano, Fujinomiya (JP); Masashi Yamauchi, Fujinomiya (JP); Atsushi Osawa, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/408,738

(22) Filed: Feb. 29, 2012

(65) Prior Publication Data

US 2012/0242770 A1 Sep. 27, 2012

(30) Foreign Application Priority Data

Mar. 23, 2011 (JP) ..... 2011-064643

(51) Int. Cl.
*B41M 5/00* (2006.01)
*B41M 5/50* (2006.01)
*B41M 5/52* (2006.01)

(52) U.S. Cl.
CPC ..... *B41M 5/508* (2013.01); *B41M 5/52* (2013.01); *B41M 5/5218* (2013.01); *B41M 5/506* (2013.01); *B41M 5/504* (2013.01); *B41M 5/5254* (2013.01)
USPC ..... 428/32.18; 428/32.2; 428/32.21; 428/32.22; 428/32.31; 428/32.34

(58) Field of Classification Search
CPC ..... B41M 5/508; B41M 5/52; B41M 5/5218; B41M 5/506; B41M 5/504; B41M 5/5254
USPC ..... 428/32.18, 32.2, 32.21, 32.22, 32.31, 428/32.34
See application file for complete search history.

(56) References Cited

U.S. PATENT DOCUMENTS

| | | | | |
|---|---|---|---|---|
| 6,436,514 | B1 | 8/2002 | Ishiyama et al. | |
| 2002/0008752 | A1 | 1/2002 | Tokunaga et al. | |
| 2005/0196541 | A1* | 9/2005 | Suzuki et al. | 427/402 |
| 2009/0202753 | A1* | 8/2009 | Teramae et al. | 428/32.2 |

FOREIGN PATENT DOCUMENTS

| | | | |
|---|---|---|---|
| JP | 07179025 | A | 7/1995 |
| JP | 2000198268 | A | 7/2000 |

(Continued)

OTHER PUBLICATIONS

Notice of Reasons for Rejection, dated Apr. 16, 2013, issued in corresponding JP Application No. 2011-064643, 4 pages in English and Japanese.

(Continued)

*Primary Examiner* — Betelhem Shewareged
(74) *Attorney, Agent, or Firm* — Sughrue Mion, PLLC

(57) ABSTRACT

An ink-jet recording medium comprising: a support including a base paper, a first polyolefin resin layer disposed on one side of the base paper, and a second polyolefin resin layer disposed on the other side of the base paper, and an ink receiving layer including inorganic particles and a water-soluble resin, the ink receiving layer being disposed on one side of the support, wherein a first surface of the support at a side that is opposite to a side at which the ink receiving layer is disposed has a centerline average roughness (Ra) of from 0.5 μm to 1.0 μm when measured in accordance with JIS-B-0601 with a cutoff value of 0.8 mm, and an average surface roughness (Sra) of 0.3 μm or less when a cutoff value is from 1 μm to 25 μm.

11 Claims, 1 Drawing Sheet

(56) References Cited

FOREIGN PATENT DOCUMENTS

| | | | |
|---|---|---|---|
| JP | 2001098492 | A | 4/2001 |
| JP | 2001-270232 | A | 10/2001 |
| JP | 2002-265106 | A | 9/2002 |
| JP | 2003-159861 | A | 6/2003 |
| JP | 2005219244 | A | 8/2005 |
| JP | 2006248154 | A | 9/2006 |

OTHER PUBLICATIONS

Decision of Refusal, dated Sep. 17, 2013, issued in corresponding JP Application No. 2011-064643, 2 pages in English and Japanese.

* cited by examiner

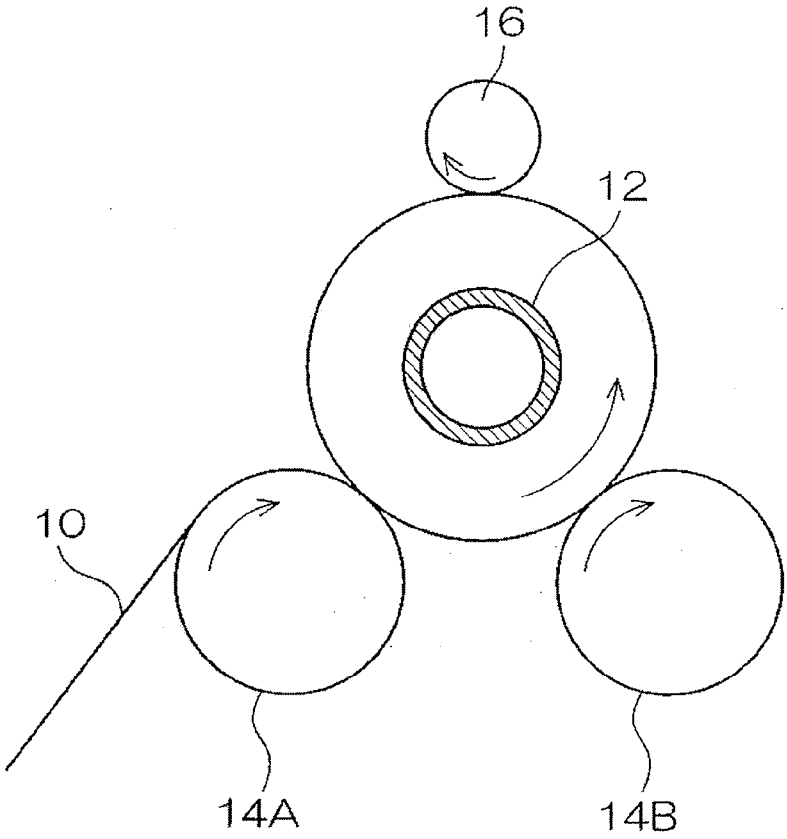
16
12
10
14A
14B

INK-JET RECORDING MEDIUM

CROSS-REFERENCE TO RELATED APPLICATIONS

This application is based on and claims priority under 35 USC 119 from Japanese Patent Application No. 2011-064643 filed on Mar. 23, 2011, the disclosure of which is incorporated by reference herein.

BACKGROUND OF THE INVENTION

1. Technical Field

The present invention relates to an ink-jet recording medium.

2. Description of the Related Art

Various methods image recording methods for recording a color image have been proposed in recent years. In each of the methods, requirements for the quality of recorded articles, such as image quality, texture, resistance to curling after recording, are high.

For example, an ink jet recording method in which an ink jet recording medium having an ink-receiving recording layer with a porous structure is used has already been put to practical use. Examples of such an ink-jet recording medium include an ink-jet recording medium including a support and a recording layer disposed thereon which includes inorganic pigment particles and a water-soluble binder, and which has high porosity. Such a recording medium has favorable properties in terms of quick drying of ink due to the highly porous structure, and is capable of recording thereon a photo-like image such as those having high glossiness.

In conjunction with the above, a method of cutting and winding an ink jet recording medium is disclosed in which a slitter apparatus having a surface winding device is employed (see, for example, Japanese Patent Application Laid-Open (JP-A) No. 2002-265106). In this method, it is thought that a decrease in glossiness of the ink receiving layer can be suppressed by lowering the pressure applied by a rider roll.

An inkjet recording medium in which a back coat layer (back layer) is disposed, for various purposes, on a face of a support at a side opposite to a side at which an ink-receiving recording layer (ink receiving layer) is disposed is known (see, for example, JP-A Nos. 2001-270232 and 2003-159861).

SUMMARY OF THE INVENTION

However, none of the above described patent documents discloses a technical thought or idea that focuses on a centerline average roughness (Ra) measured in accordance with JIS (Japanese Industrial Standards)-B-0601 with a cutoff value of 0.8 mm or a surface average roughness (Sra) with a cutoff value of from 1 μm to 25 μm from among surface roughness parameters of a face of the support which is opposite to a face on which an ink receiving layer is disposed, and that suggests that various advantages described below, such as suppression of generation of unevenness due fogging resulting from adhesion of polyolefin resin, can be obtained by controlling these parameters.

It is an object of the present invention to provide an ink jet recording medium which has an improved anti-blocking properties, and with which unevenness due to fogging resulting from adhesion of polyolefin resin and unevenness due to fogging resulting from pressure application, which may be generated when an ink-jet recording medium having a base paper and a polyolefine layer disposed on both sides of the base paper is treated with a surface winding apparatus, can be suppressed.

The above described technical problem can be solved by the following technical solutions.

<1> An ink jet recording medium including:

a support including a base paper, a first polyolefin resin layer disposed on one side of the base paper, and a second polyolefin layer disposed on the other side of the base paper; and an ink receiving layer including inorganic particles and a water-soluble resin, the ink receiving layer being disposed on one side of the support, wherein a first surface of the support at a side that is opposite to a side at which the ink receiving layer is disposed has a centerline average roughness Ra of from 0.5 μm to 1.0 μm when measured in accordance with JIS-B-0601 with a cutoff value of 0.8 mm, and an average surface roughness (Sra) of 0.3 μm or less when a cutoff value is from 1 μm to 25 μm.

<2> The ink-jet recording medium according to <1>, wherein a coefficient of static friction between the ink receiving layer and a surface of the ink-jet recording medium at a side opposite to a side at which the ink receiving layer is disposed is 0.8 or higher.

<3> The ink-jet recording medium according to <1>, wherein the first surface of the support has a centerline average roughness Ra of from 0.6 μm to 0.9 μm when measured in accordance with JIS-B-0601 with a cutoff value of 0.8 mm.

<4> The ink-jet recording medium according to <1>, wherein the first surface of the support has an average surface roughness (Sra) of 0.25 μm or less when a cutoff value is from 1 μm to 25 μm.

<5> The ink-jet recording medium according to <1>, wherein the first polyolefin resin layer is disposed on the same side of the base paper as the ink receiving layer, and an average surface roughness (Sra) of the first polyolefin resin layer is from 0.02 μm to 0.20 μm at a frequency of from 0.2 mm to 0.3 mm.

<6> The ink-jet recording according to <2>, wherein a coefficient of static friction between the ink receiving layer and a surface of the ink jet recording medium at a side opposite to a side at which the ink receiving layer is disposed is from 0.8 to 1.5.

<7> The ink-jet recording according to <2>, wherein a coefficient of static friction between the ink receiving layer and a surface of the ink jet recording medium at a side opposite to a side at which the ink receiving layer is disposed is from 0.8 to 1.2.

<8> The ink-jet recording according to <1>, further including a back layer that includes a binder resin on the first surface of the support.

<9> The ink-jet recording according to <8>, wherein the back layer further includes an organic pigment.

<10> The ink-jet recording according to <1>, wherein the first surface of the support has been pressed against a chill roll.

<11> An ink jet recording medium comprising a support and an ink receiving layer, wherein a coefficient of static friction between the ink receiving layer and a surface of the ink jet recording medium at a side opposite to a side at which the ink receiving layer is disposed is 0.8 or greater.

According to the present invention, it is possible to provide an ink-jet recording medium which has an improved anti-blocking properties, and with which unevenness due to fogging resulting from adhesion of polyolefin resin and unevenness due to fogging resulting from pressure application, which may be generated when an ink-jet recording medium having a base paper and a polyolefine layer disposed on both sides of the base paper is treated with a surface winding apparatus, can be suppressed.

BRIEF DESCRIPTION OF THE DRAWING

FIG. 1 is a schematic diagram showing an example of the configuration of a surface winding apparatus.

DETAILED DESCRIPTION

An exemplary embodiment of the present invention is described by reference to FIG. 1 attached hereto.

FIG. 1 schematically illustrates an example of the configuration of a surface winding apparatus. The surface winding apparatus in FIG. 1 includes: a winding core 12 around which an inkjet recording medium 10 is to be wound; and driving rollers 14A and 14B and a pressing roller 16 which are arranged around the winding core 12. The rollers 14A, 14B and 16 rotate in a state in which the rollers are pressed against a surface of a portion of the ink jet recording medium 10 that is wound around the winding core 12. With this rotation, the portion of the ink-jet recording medium 10 that is wound around the winding core 12 also rotates, whereby the ink-jet recording medium 10 is wound sequentially.

In a case in which winding is carried out using a surface winding apparatus during preparation of an ink-jet recording medium in which a polyolefin layer is disposed on both sides of a base paper in order to suppress curling at high humidity, and an ink receiving layer is further disposed on a polyolefin layer at one side, the polyolefin resin of the polyolefin layer of a portion of the ink jet recording medium which is to be wound next may adhere to the surface of the ink receiving layer of another portion of the recording medium due to, for example, rubbing of overlapped portions of the recording medium against each other due to the pressure applied by the pressing roller 16, as a result of which unevenness due to fogging may be generated in the ink receiving layer.

Further, in a case in which the coating speed during the formation of the ink receiving layer is increased, and the length of the ink jet recording medium to be wound around the winding core is increased in order to increase productivity, the pressure applied by the pressing roller 16 needs to be increased in order to prevent positional deviation of the wound ink-jet recording medium. However, when the pressure applied by the pressing roller 16 is increased, it is more likely that unevenness due to fogging develops in the ink receiving layer due to the pressure application.

Further, in a case in which a water-soluble resin is used as a binder in the ink receiving layer, the water-soluble resin may tightly adhere to the back face of another portion of the ink-jet recording medium, whereby blocking may occur.

The inventors of the present invention earnestly studied to seek possible measures to suppress the generation of unevenness due to fogging resulting from adhesion of polyolefin resin or unevenness due to fogging resulting from pressure application, and also to improve anti-blocking properties, and, as a result, the inventors have found that the generation of unevenness due to fogging resulting from polyolefin adhesion or pressure application can be effectively suppressed, and anti-blocking properties can be improved, by adjusting the centerline average roughness and surface average roughness of a surface of the support at a side opposite to a side at which the ink receiving layer is disposed to be within specific ranges.

Ink-Jet Recording Medium

The ink-jet recording medium according to the present invention includes:

a support including a base paper and a polyolefin resin layer disposed on both sides of the base paper; and an ink receiving layer including inorganic particles and a water-soluble resin and disposed on one side of the support, wherein a surface of the support at a side opposite to a side at which the ink receiving layer is disposed has a centerline average roughness (Ra) of from 0.5 μm to 1.0 μm when measured in accordance with JIS-B-0601 (which is incorporated herein by reference) with a cutoff value of 0.8 mm, and a surface average roughness (Sra) of 0.3 μm or less when a cutoff value is from 1 μm to 25 μm.

When the ink jet recording medium having such a structure is used, it is possible to suppress the generation of unevenness due to fogging resulting from adhesion of polyolefin resin or unevenness due to fogging resulting from pressure application during the processing of the ink-jet recording medium with a surface winding apparatus.

The unevenness due to fogging resulting from adhesion of polyolefin resin as used herein means a state in which unevenness in glossiness is generated on a surface of the ink receiving layer (especially, a state in which visually-observable unevenness in glossiness is generated when an image is formed on the ink receiving layer) after a side of the ink jet recording medium having the ink receiving layer and the opposite side of the ink jet recording medium (on which a back layer may be provided) are faced to each other and superposed one on the other, and rubbed against each other. It is presumed that the unevenness due to fogging resulting from adhesion of polyolefin resin is caused by, for example, rubbing of the upper side (the ink receiving layer) of one portion of the ink jet recording medium and the lower side of an overlying portion of the ink jet recording medium against each other due to positional deviation therebetween when the pressure applied to the ink jet recording medium during the processing with an surface winding apparatus is reduced.

The unevenness due to fogging resulting from pressure application means a state in which visually-observable unevenness in glossiness is generated when an image is formed on the ink receiving layer after a side of the ink-jet recording medium having the ink receiving layer and the opposite side of the ink jet recording medium (on which a back layer may be provided) are faced to each other and superposed one on the other, and pressure is applied thereto. It is presumed that the unevenness due to fogging resulting from pressure application is caused by, for example, generation of depressed portions on the surface of the ink receiving layer due to the presence of protruding portions on the back face of the ink-jet recording medium under application of strong pressure when the pressure applied during the processing with a surface winding apparatus is increased.

Further, when a water-soluble resin is used as a binder in the ink receiving layer, the water-soluble resin may adhere to the back face of the ink jet recording medium, thereby causing blocking The reason why the configuration of the present invention suppresses the unevenness due to fogging resulting from adhesion of polyolefin resin and the unevenness due to fogging resulting from pressure application when the ink-jet recording medium is processed with a surface winding apparatus, and also improves anti-blocking properties is presumed as follows. That is, since the surface roughness in a micron scale of the back face of the ink jet recording medium is set to be small, the pressure applied per unit area is maintained low, whereby adhesion of the polyolefin resin is suppressed, thereby suppressing the unevenness due to fogging resulting from polyolefin adhesion and the unevenness due to fogging resulting from pressure application; moreover, since the surface roughness in a millimeter scale of the back face of the ink jet recording medium is maintained to be relatively large, the area of contact between the back face and the surface of an ink receiving layer is maintained relatively small, thereby improving the anti-blocking properties of the ink jet recording medium.

Support

The support of the ink-jet recording medium of the present invention includes a base paper, and a polyolefin resin layer disposed on both sides of the base paper. Since the support includes a polyolefin resin layer, the support has excellent glossiness and water resistance.

With respect to the water-resistance, the support has a water absorption in terms of Cobb size of preferably 5 g/cm$^2$ or less, more preferably 2 g/cm$^2$ or less, and still more preferably 1 g/cm$^2$ or less. The water absorption in terms of Cobb Size is a value obtained by measuring the water absorption amount of a sample when pure water and the sample are contacted with each other for 30 seconds in accordance with JIS P8140, which is incorporated by reference herein.

Base Paper

The main raw material of the base paper for use in the invention may be wood pulp. When making the base paper, synthetic pulp such as polypropylene or synthetic fiber such as nylon or polyester may be used, as necessary, in addition to wood pulp. Any of LBKP, LBSP, NBKP, NBSP, LDP, NDP, LUKP, or NUKP may be used as the wood pulp. It is preferable to use one or more of LBKP, NBSP, LBSP, NDP and LDP, which have high contents of short fibers, in greater amounts. The proportion of LBSP and/or LDP is preferably from 10% by mass to 70% by mass.

The pulp is preferably a chemical pulp (such as sulfate pulp or sulfite pulp), which has a lower impurity content. A pulp of which whiteness has been improved by bleaching treatment is also useful.

One or more of the following agents may be added into the base paper as necessary: a sizing agent such as a higher fatty acid or an alkylketene dimer, a white pigment such as calcium carbonate, talc, or titanium oxide, a paper-strength enhancing agent such as starch, polyacrylamide, or polyvinyl alcohol, a fluorescent whitening agent, a moisture retaining agent such as a polyethylene glycol, a dispersant, a softener such as quaternary ammonium, or the like.

The freeness of the pulp used for paper-making is preferably from 200 mL to 500 mL in terms of C.S.F (Canadian Standard Freeness). Further, concerning the fiber length after beating, the sum of the percentage by mass of the pulp remaining on a 24-mesh screen and the percentage by mass of the pulp remaining on a 42-mesh screen according to JIS P-8207 (which is incorporated herein by reference) is preferably from 30% by mass to 70% by mass. In addition, the percentage by mass of the pulp remaining on a 4-mesh screen is preferably 20% by mass or lower.

The basis weight of the base paper is preferably from 30 g/m$^2$ to 250 g/m$^2$, and more preferably from 50 g/m$^2$ to 200 g/m$^2$. The thickness of the base paper is preferably from 40 μm to 250 μm. The base paper may be subjected to calender treatment during or after paper-making so as to have high smoothness. The density of the base paper is generally from 0.7 g/cm$^3$ to 1.2 g/cm$^3$ (according to JIS P8118, which is incorporated herein by reference). The stiffness of the base paper is preferably from 20 g to 200 g under the conditions according to JIS P8125, which is incorporated herein by reference.

A surface size agent may be coated on the surface of the base paper. Examples of the surface size agent include the above described size agents that can be added to the base paper.

The pH of the base paper is preferably from 5 to 9 when measured by a hot water extraction method provided by JIS P-8113, the disclosure of which is incorporated by reference herein.

One or both sides of the base paper may be subjected to various kinds of surface treatments or undercoat treatments for the purpose of improving adhesion to the layer to be disposed thereon. Examples of the surface treatment include a patterning treatment, such as a gloss surface treatment, a fine surface treatment described in JP-A No. 55-26507, a matte surface treatment, or a silky surface treatment, and an activation treatment such as a corona discharge treatment, a flame treatment, a glow discharge treatment, or a plasma treatment. Examples of the undercoat treatment include the methods such as those described in JP-A No. 61-846443.

One kind of these surface treatments and undercoat treatments may be performed singly, or any two or more of these treatments may be combined. For example, an activation treatment may be performed after performing a patterning treatment or the like; or an undercoat treatment may be performed after performing surface treatment such as an activation treatment or the like.

Polyolefin Resin Layer

The support in the invention includes a polyolefin resin layer, which is a resin layer containing, preferably as a main component thereof, a polyolefin resin, on both sides of the base paper. In other words, the support includes the base paper, a first polyolefin resin layer disposed on one side of the base paper, and a second polyolefin resin layer disposed on the other side of the base paper.

Examples of the polyolefin resin used in the polyolefin resin layer include polyethylene and polypropylene. The polyethylene to be used is not particularly limited, and may be a high density polyethylene (HDPE), low density polyethylene (LDPE), or linear low density polyethylene (L-LDPE). From the viewpoint of the stiffness of a support for photographic paper, it is preferable to use, for example, polypropylene, high density polyethylene (HDPE), or linear low density polyethylene (L-LDPE). These resins may be used singly, or in mixture of two or more thereof.

Here, high density polyethylene and low density polyethylene are defined in JIS K6748:1995, which is incorporated herein by reference. High density polyethylene is polyethylene having a density of 0.942 g/cm$^3$ or higher, and low density polyethylene is polyethylene having a density of from 0.910 g/cm$^3$ to 0.930 g/cm$^3$. Linear low density polyethylene is polyethylene defined in JIS K6899-1:2000, which is incorporated herein by reference.

Generally, the polyolefin resin layer is formed using, typically, low density polyethylene. With a view to improving the thermal resistance of the support, it is preferable to use polypropylene, a blend of polypropylene and polyethylene, high density polyethylene, or a blend of high density polyethylene and low density polyethylene. Particularly, from the viewpoints of costs, laminate suitability and the like, it is more preferable to use a blend of high density polyethylene and low density polyethylene.

The blend of high density polyethylene and low density polyethylene may be, for example, a blend having a blend ratio (high density polyethylene/low density polyethylene in terms of mass ratio) of from 1/9 to 9/1. The blend ratio is preferably from 2/8 to 8/2, and more preferably from 3/7 to 7/3.

The molecular weight of polyethylene is not particularly limited. The high density polyethylene preferably has a melt index according to JIS-K 7210 within a range of from 1.0 g/10 min to 40 g/10 min and extrusion suitability. The low density polyethylene preferably has a melt index according to JIS-K 7210 within a range of from 1.0 g/10 min to 40 g/10 min and extrusion suitability. JIS-K 7210 is incorporated herein by reference.

The method of forming the polyolefin resin layer on both sides of the base paper is not particularly limited, and may be selected depending on the purpose as appropriate. For example, the polyolefin resin layer may be formed by any of the following (i) to (iv): (i) dry-laminating, or adhering, a polyolefin film onto the base paper, (ii) coating a polyolefin resin on the base paper using a solvent, (iii) aqueous-coating a polyolefin resin on the base paper using a polyolefin emulsion, (iv) impregnating the base paper with a polyolefin emulsion, or (v) melt-extrusion coating a polyolefin resin on the base paper. From the points of productivity, the polyolefin resin layer is preferably formed by melt-extrusion coating.

The thickness of the polyolefin resin layer is not particularly limited. From the viewpoints of smoothness and water resistance, the thickness of the polyolefin resin layer is preferably from 1 μm to 50 μm, and more preferably from 10 μm to 50 μm.

The thickness of the polyolefin resin layer referred herein is a value determined by cutting the polyolefin resin layer using a microtome (trade name: MICROTOME RM2165, manufactured by LEICA) to obtain a slice and measuring the thickness of the slice using an optical microscope (trade name, OPTICAL MICROSCOPE BX-60, manufactured by OLYMPUS CORPORATION).

A surface of the support at a side that is opposite to a side at which an ink receiving layer is disposed, which is hereinafter sometimes referred to as "back surface", is a surface of the polyolefin resin layer. The back surface of the support has a centerline average roughness (Ra) of from 0.5 μm to 1.0 μm when measured in accordance with JIS-B-0601 with a cutoff value of 0.8 mm, and a surface average roughness (Sra) of 0.3 μm or less when a cutoff value is from 1 μm to 25 μm. The centerline average roughness (Ra) when measured in accordance with JIS-B-0601 with a cutoff value of 0.8 mm is hereinafter simply referred to as "Ra". The surface average roughness (Sra) when a cutoff value is from 1 μm to 25 μm is hereinafter simply referred to as "Sra".

When the centerline average roughness (Ra) of the back surface of the support is less than 0.5 μm when measured in accordance with JIS-B-0601 with a cutoff value of 0.8 mm, the degree of blocking increases. Therefore an Ra of less than 0.5 μm is unfavorable. When the Ra of the back surface of the support is larger than 1.0 μm, unevenness due to fogging caused by polyolefin resin adhesion or unevenness due to fogging caused by pressure application are generated. Therefore, an Ra of larger than 1.0 μm is also unfavorable.

The Ra of the back surface of the support as measured in accordance with JIS-B-0601 with a cutoff value of 0.8 mm is preferably from 0.6 μm to 0.9 μm, from the viewpoints of suppression of blocking, unevenness due to fogging caused by polyolefin resin adhesion, and unevenness due to fogging caused by pressure application.

The Ra can be measured with a surface profile measurement apparatus NANOMETRO 110F (trade name; manufactured by Kuroda Precision Industries Ltd.).

The measurement conditions are as follows.

Scanning direction: machine direction (MD) of sample

Measurement length: 50 mm in X direction and 30 mm in Y direction

Measurement pitch: 0.1 mm in X direction and 1.0 mm in Y direction

Scanning velocity: 30 mm/sec.

When the surface average roughness (Sra) of the back surface of the support exceeds 0.3 μm when a cutoff value is from 1 μm to 25 μm, unevenness due to fogging caused by polyolefin resin adhesion or unevenness due to fogging caused by pressure application are generated. Therefore, a Sra of larger than 0.3 μm is unfavorable.

The Sra of the back surface of the support is preferably 0.28 μm or less, and more preferably 0.25 μm or less, from the viewpoints of suppression of generation of the unevenness due to fogging.

The Sra can be measured with an apparatus NEW VIEW 5022 (trade name; manufactured by Zygo).

As a result of adjusting the Ra and the Sra of the back surface of the support to be within the above ranges, the micron-order surface roughness of the back surface decreases, and the contact area increases, whereby the pressure applied per unit area decreases. Moreover, since a millimeter-order long-frequency surface roughness of the back surface increases, the area of contact with the ink receiving layer decreases, and the area at which adhesion to the ink receiving layer can occur also decreases, whereby the generation of unevenness due to fogging caused by polyolefin resin adhesion or unevenness due to fogging caused by pressure application during the processing of the ink-jet recording medium with a surface winding apparatus is suppressed, and anti-blocking properties can be improved.

The Ra and the Sra of the back surface can be adjusted to be within the above ranges using a chill roll which has a geometry having a predetermined surface roughness.

Herein, the chill roll is a roll used for cooling immediately after lamination by extrusion of a polyethylene resin.

The surface roughness (Sra) of the polyolefin resin layer disposed at a side at which an ink receiving layer is disposed (i.e., the polyolefin resin layer disposed between the base paper and the ink receiving layer) is not particularly restricted. From the viewpoints of image clarity, smoothness and surface defects of the recording medium, the surface roughness (Sra) of the polyolefin resin layer disposed at the ink receiving layer side is preferably from 0.02 μm to 0.20 μm when the frequency is from 0.2 mm to 0.3 mm.

When the surface roughness of the polyolefin resin layer disposed at a side at which the ink receiving layer is disposed is from 0.02 μm to 0.20 μm, the image clarity and the smoothness of the recording medium can be improved, and the surface defects of the recording medium can easily be suppressed. Therefore, the surface roughness of the polyolefin resin layer disposed at the ink receiving layer side is preferably from 0.02 μm to 0.20 μm The surface roughness of the polyolefin resin layer disposed at a side at which the ink receiving layer is disposed is a value measured with an apparatus NEW VIEW 5022 (trade name; manufactured by Zygo).

The polyolefin resin layer preferably contains a white pigment or a fluorescent whitening agent, as necessary, in addition to the polyolefin resin.

The fluorescent whitening agent is a compound that has absorption in the near ultraviolet region and emits fluorescence at an emission wavelength of from 400 nm to 500 nm. Any known fluorescent whitening agent may be used without particular limitations. Preferable examples of the fluorescent whitening agent include the compounds described in "The Chemistry of Synthetic Dyes", volume V, chapter 8, edited by K. VeenRataraman. Specific examples of the fluorescent whitening agent include a stilbene compound, a coumalin compound, a biphenyl compound, a benzoxazoline compound, a naphthalimide compound, a pyrazoline compound, and a carbostyril compound. More specific examples include WHITE FULFAR PSN, PHR, HCS, PCS, and B (trade names, all manufactured by Sumitomo Chemical Co., Ltd.), and UVITEX-OB (trade name, manufactured by BASF).

Examples of the white pigment include titanium oxide, calcium carbonate, barium sulfate, and zinc oxide. Among these, titanium oxide is preferable from the point of shielding properties.

The content of the white pigment or the fluorescent whitening agent in the polyolefin resin layer is preferably from 0.1 $g/m^2$ to 8 $g/m^2$, and more preferably from 0.5 $g/m^2$ to 5 $g/m^2$. When the content is smaller than 0.1 $g/m^2$, light transmittance of the support becomes high. When the content exceeds 8 $g/m^2$, cracking of the surface of the support may occur, and handling properties such as anti-adhesion properties may deteriorate.

(Back Layer)

The ink-jet recording medium of the present invention preferably includes a back layer on the polyolefin resin layer disposed at a side of the support that is opposite to a side at which the ink receiving layer is disposed. However, the back layer is not essential, and the outermost surface of the ink jet recording medium at the back side may be the surface of the polyolefin resin layer disposed on the back side of the base paper.

Resin

The back layer preferably includes a resin as a binder. The resin included in the back layer is preferably a water-insoluble resin. However the resin included in the back layer as a binder is not specifically restricted, and any known water dispersible resin may be used. These resins may be used singly, or in mixture of two or more thereof. Any known water-dispersible latex can suitably be used as the water-insoluble resin.

The water-dispersible latex may further include one or more additional components in addition to the water-insoluble resin. Any known component may be used as a component to be added without particular restriction as long as the component can be used together with the water-insoluble resin.

The water-dispersible latex is a dispersion in which a hydrophobic polymer that is insoluble or poorly soluble in water is dispersed, in the form of fine particles, in a dispersion medium as an aqueous phase. The dispersion state thereof may be any of a state in which the polymer is emulsified in the dispersion medium, a state in which the polymer has been prepared in the dispersion medium by emulsion polymerization, a state in which the polymer is micelle-dispersed in the dispersion medium, a state in which polymer chains themselves are molecular-dispersed due to a hydrophilic structure present in a part of the polymer molecule, or the like. Such water-dispersible latexes are described in detail in, for example, "Gosei Jushi Emulsion", edited by Taira Okuda & Hiroshi Inagaki, published by Kobunshi Kankokai (1978); "Gosei Latex no Oyo", edited by Takaaki Sugimura, Yasuo Kataoka, Sohichi Suzuki & Keiji Kasahara, published by Kobunshi Kankokai (1993); and "Gosei Latex no Kagaku," written by Sohichi Muroi, published by Kobunshi Kankokai (1970), the disclosures of which are incorporated by reference herein.

Specific examples of the latex include latexes of thermoplastic resins, examples of which include an acrylic latex, an acrylic silicone latex, an acryl-epoxy latex, an acryl-styrene latex, an acryl-urethane latex, a styrene-butadiene latex, a styrene-isoprene latex, an acrylonitrile-butadiene latex, a polyester-urethane latex, and a vinyl acetate latex.

With a view to suppressing unevenness due to fogging and improving transportability and stack-collection properties, the latex is preferably at least one selected from a urethane latex (such as an acryl-urethane latex or a polyester-urethane latex), an acrylic silicone latex, an acryl styrene latex, a styrene-isoprene latex or a styrene-butadiene latex, and is more preferably at least one selected from a urethane latex, a styrene-isoprene latex or a styrene-butadiene latex.

The number average molecular weight of the water-insoluble resin in the latex is preferably from 300 to 1,000,000, and more preferably from about 500 to about 100,000. When the resin has a number-average molecular weight of 300 or higher, unevenness due to fogging can be suppressed more effectively. A number-average molecular weight of 1,000,000 or lower is preferable in terms of suitability for production such as dispersion stability and viscosity.

The acrylic latex may be a commercially available product. Examples thereof include water-dispersible latexes of resins such as: acrylic resins such as CEVIAN A4635, 46583 and 4601 (trade names, manufactured by DAICEL CHEMICAL INDUSTRIES, LTD.) and NIPOL LX 811, 814, 821, 820 and 857 (trade names, manufactured by ZEON CORPORATION). In particular, the acrylic emulsions of acrylic silicone latexes disclosed in JP-A Nos. 10-264511, 2000-43409, 2000-343811 and 2002-120452, commercially available products of which include AQUABRID series UM7760, UM7611 and UM4901, and AQUABRID 903, AQUABRID 46704, AQUABRID ASi-86, AQUABRID ASi-89, AQUABRID ASi-91, AQUABRID ASi-753, AQUABRID 4635, AQUABRID 4901, AQUABRID MSi-04S, AQUABRID AU-124, AQUABRID AU-131, AQUABRID AEA-61, AQUABRID AEC-69 and AQUABRID AEC-162 (trade names, manufactured by DAICEL CHEMICAL INDUSTRIES, LTD.), are also preferable for use.

Examples of commercially available polyester-urethane latexes include HYDRAN AP series (for example, HYDRAN AP-20, HYDRAN AP-30, HYDRAN AP-30F, HYDRAN AP-40(F), HYDRAN AP-50LM, HYDRAN APX-60LM, HYDRAN APX-101H, HYDRAN APX-110 and HYDRAN APX-501 (trade names) manufactured by DIC CORPORATION.

Examples of commercially available styrene-isoprene latexes includes LACSTAR 7310K, 3307B, 4700H and 7132C (trade names, manufactured by DIC), NIPOL LX416, LX410, LX430, LX435, LX110, LX415A, LX438C, 2507H, LX303A, LX407BP series, V1004 and MH5055 (trade names, manufactured by ZEON CORPORATION).

It is preferable to use at least one of the above described latexes. These latexes may be used singly, or, alternatively, in combination of two or more thereof The glass transition temperature (Tg) of the water-insoluble resin is preferably from −20° C. to 70° C., and more preferably from −10° C. to 50° C. When the Tg is within the foregoing ranges, unevenness due to fogging can be more effectively suppressed, and transportability and stack-collection properties also improve.

The minimum film-formation temperature (MFT) of the water-insoluble resin, which is preferably in the form of a water-dispersible latex, is preferably from −20° C. to 50° C., and more preferably from −10° C. to 40° C.

When the MFT at which film formation can be performed is within the foregoing ranges, unevenness due to fogging can be suppressed further effectively, and transportability and stack-collection properties also improve.

Other Components

The back layer may include an organic pigment. Examples of the organic pigment include a styrene plastic pigment, an acrylic plastic pigment, polyethylene, microcapsules, a urea resin, and a melamine resin.

The back layer may include an additive such as an aqueous binder, an oxidation inhibitor, a surfactant, a defoaming agent, an anti-foaming agent, a pH adjuster, a curing agent, a coloring agent, a fluorescent whitening agent, an antiseptic agent, or a water-resistant additive.

Examples of the aqueous binder include a water-soluble polymer such as a copolymer of styrene and a maleic acid salt, a copolymer of styrene and an acrylic acid salt, polyvinyl alcohol, silanol-modified polyvinyl alcohol, starch, cationized starch, casein, gelatin, carboxymethyl cellulose, hydroxyethyl cellulose, or polyvinylpyrrolidone; and a water-dispersible polymer such as a styrene-butadiene latex or an acrylic emulsion.

In the invention, the amount of solids applied (hereinafter referred to as "solid application amount") of the back layer is preferably from 0.05 g/m$^2$ to 0.5 g/m$^2$, and, from the viewpoints of improvement in transportability and stack-collection properties, is more preferably from 0.1 g/m$^2$ to 0.4 g/m$^2$.

The solid application amount of the back layer means the total amount (mass) of the components of the back layer, except for water, that has been applied, and, when the back layer is formed by coating, the solid application amount of the back layer is the total coating amount of the components, except for water, that are contained in the coating liquid for forming the back layer.

From the viewpoints of transportability and stack-collection properties, it is preferable that the back layer in the invention includes starch particles and at least one water-insoluble resin selected from a urethane latex, an acrylic silicone latex, an acryl-styrene latex, a styrene-isoprene latex and a styrene-butadiene latex at a mass ratio of from 0.5 to 12 (the content of the starch particles/the content of the water-insoluble resin(s), and that the solid application amount is from 0.1 g/m$^2$ to 2 g/m$^2$.

The method of forming the back layer in the invention is not particularly limited, and the back layer may be formed by a commonly-employed layer forming method such as a coating method.

For example, the back layer may be formed by applying a coating liquid for forming a back layer to a side of the support that is opposite to a side at which the ink receiving layer is disposed so as to attain a desired solid application amount, and drying the resultant coating layer. The coating liquid for forming a back layer may include starch particles and a water-insoluble resin (preferably a water-dispersible latex), and may further include one or more other components as necessary, The coating liquid for forming a back layer may be applied by a known coating method. Specifically, the coating liquid for forming a back layer may be applied by any of the methods described below that may be employed for applying a coating liquid for forming an ink receiving layer.

The drying conditions may be selected, as appropriate, in accordance with the coating amount. The drying may be carried out, for example, at a temperature of from 40° C. to 180° C. for 0.5 minutes to 10 minutes.

(Ink Receiving Layer)

The ink-jet recording medium of the present invention includes, on one side of the support (opposite to the back layer side), an ink receiving layer that includes at least one kind of inorganic particles and at least one water-insoluble resin, and that may further include one or more other components, as necessary.

Inorganic Particles

Examples of the inorganic particles include silica particles, colloidal silica, titanium dioxide particles, barium sulfate particles, calcium silicate particles, zeolite particles, kaolinite particles, halloysite particles, mica particles, talc particles, calcium carbonate particles, magnesium carbonate particles, calcium sulfate particles, boehmite particles, and pseudoboehmite particles. Among these, silica particles are preferable.

Use of silica enables achievement of high color density and favorable color exhibiting properties. This is because silica particles, having a particularly large specific surface area, are effective with respect to absorption and retention of ink, and the low refractive index thereof allows formation of a transparent ink receiving layer when the silica particles are dispersed to have an adequately small particle diameter. The transparency of the ink receiving layer is important from the viewpoints of obtaining high color density and favorable color exhibiting properties and glossiness, in a case in which the ink-jet recording medium of the invention is applied as a recording sheet such as a photo glossy paper.

The average primary particle diameter of the inorganic particles is preferably 20 nm or less, more preferably 15 nm or less, and particularly preferably 10 nm or less. When the average primary particle diameter is 20 nm or less, ink absorption characteristics can be effectively improved, and glossiness of the surface of the ink receiving layer can also be enhanced.

The specific surface area of the inorganic particles as determined by the BET method is preferably 200 m$^2$/g or greater, more preferably 250 m$^2$/g or greater. When the specific surface area of the inorganic particles is 200 m$^2$/g or greater, high transparency of the ink receiving layer and high image density can be achieved.

The BET method as referred to in the present invention is a method of measuring the surface area of powder using a vapor-phase adsorption method, and is a method of determining a specific surface area, that is the total surface area per 1 g of a specimen, from an adsorption isotherm. In the BET method, nitrogen gas is often used as a gas to be adsorbed. A method in which the adsorption amount is determined from a change in pressure or volume of the adsorbed gas is most widely used. An equation proposed by Brunauer, Emmett, and Teller, which is called a BET equation, is the most famous equation representing an isotherm of multimolecular adsorption. The BET equation is widely used for determining a surface area. An adsorption amount is determined on the basis of the BET equation, and the resulting adsorption amount is multiplied by an area on the surface occupied by one adsorbed molecule, whereby the surface area is determined.

Silica particles have silanol groups on surfaces thereof. The particles easily adhere to each other through hydrogen bonding of the silanol groups, and particles are adhered to one another also via an interaction between the water-soluble resin and the silanol groups. Hence, when the average primary particle diameter of silica particles is 20 nm or less as described above, the ink receiving layer can have a structure having a high porosity and a high transparency, and the ink absorption characteristics of the ink receiving layer can be effectively improved.

In the present invention, the inorganic particles is most preferably fumed silica particles having a specific surface area of 200 m$^2$/g or more as determined by the BET method.

Water-Soluble Resin

Examples of the water-soluble resin include polyvinyl alcohol resins having a hydroxyl group as a hydrophilic group (for example, polyvinyl alcohol (PVA), acetoacetyl-modified polyvinyl alcohol, cation-modified polyvinyl alcohol, anion-modified polyvinyl alcohol, silanol-modified polyvinyl alcohol, and polyvinyl acetal), cellulose resins (for example, methyl cellulose (MC), ethyl cellulose (EC), hydroxyethyl cellulose (HEC), carboxymethyl cellulose (CMC), hydroxypropyl cellulose (HPC), hydroxyethyl methyl cellulose, and hydroxypropyl methyl cellulose), chitins, chitosans, starches, resins having an ether bond (for example, polyethylene oxide (PEO), polypropylene oxide (PPO), and polyvinyl ether (PVE)), and resins having a carbamoyl group (for example, polyacrylamide (PAAM), polyvinyl pyrrolidone (PVP), and polyacrylic acid hydrazide). Examples of the water-soluble resin further include polyacrylic acid, maleic acid resins, alginic acid, and gelatins, each of which has a carboxyl group and/or a salt thereof as a dissociative group.

Among the above resins, polyvinyl alcohol resins are particularly preferable. Examples of polyvinyl alcohol resins include those described in Japanese Patent Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105 and 11-348417, the disclosures of which are incorporated by reference herein.

Further, examples of water-soluble resins other than polyvinyl alcohol resins include the compounds described in paragraphs [0011] to [0014] of JP-A No. 11-165461, the disclosures of which are incorporated by reference herein.

The water-soluble resin may be used singly, or two or more thereof may be used in combination.

The content of the water-soluble resin for use in the present invention is preferably from 9% by mass to 40% by mass, and more preferably from 12% by mass to 33% by mass, with respect to the total solid mass of the ink receiving layer.

The inorganic particles and the water-soluble resin are main components of the ink receiving layer. The inorganic particles may be composed of a single material or may be a mixture of plural materials. The water-soluble resin may be composed of a single material or may be a mixture of plural materials.

The kind of water-soluble resin which is used in combination with the inorganic particles is important from the viewpoint of improving image density while maintaining transparency. The water-soluble resin is preferably a polyvinyl alcohol resin, more preferably a polyvinyl alcohol resin having a saponification degree of from 70% to 100%, and further preferably a polyvinyl alcohol resin having a saponification degree of from 80% to 99.5%.

A water-soluble resin other than the polyvinyl alcohol resin may be used in combination with the polyvinyl alcohol resin. When used in combination, the content of polyvinyl alcohol resin is preferably 50% by mass or higher, and more preferably 70% by mass or higher, with respect to the total content of water-soluble resins in the ink receiving layer.

Content Ratio of Inorganic Particles to Water-Soluble Resin

The content ratio by mass (PB ratio (x:y)) of inorganic particles (x) to water-soluble resin (y) exerts a large influence on the film structure and the film strength of the ink receiving layer. Specifically, there is a tendency that, as the content ratio by mass (PB ratio) increases, the porosity, the pore volume, and the surface area (per unit mass) of the ink receiving layer increases while the density and the strength of the ink receiving layer decreases.

In the present invention, the content ratio by mass (PB ratio (x:y)) in the ink receiving layer is preferably in a range of from 1.5:1 to 10:1 from the viewpoints of suppressing a decrease in film strength and the cracks occurring during drying due to excessively high PB ratios, and suppressing decrease in ink absorbency which results from decrease in a porosity due to an increased tendency for pores to be clogged by the resins, which is caused by excessively low PB ratios.

When a recording medium is passed through a transporting system of an image recording apparatus, the recording medium may receive stress. Therefore, the ink receiving layer is required to have sufficient film strength. Moreover, the sufficient film strength of the ink receiving layer is required also from the viewpoint of preventing cracking, detachment, or the like of the ink receiving layer when the recording medium is cut into sheets. In view of the above, the content ratio by mass (x:y) is more preferably 5:1 or lower, and, from the viewpoint of providing the ability to rapidly absorb ink when the recording medium is used in an inkjet printer, the content ratio by mass (x:y) is more preferably 2:1 or higher.

For example, a three-dimensional network structure having secondary particles of the silica particles as the network chains may be formed by completely dispersing fumed silica having an average primary particle diameter of 20 nm or less (x) and a water-soluble resin (y) in an aqueous solution at a content ratio by mass (x:y) of from 2:1 to 5:1, applying the resultant solution onto the support, and then drying the coating layer obtained, whereby a light transmitting porous film having an average pore diameter of 30 nm or less, a porosity of from 50% to 80%, a specific pore volume of 0.5 mL/g or more, and a specific surface area of 100 $m^2/g$ or higher can easily be formed.

Other Components

The ink receiving layer in the invention may include one or more other known additives, as necessary, such as crosslinking agents, acids, ultraviolet absorbers, antioxidants, fluorescent whitening agents, monomers, polymerization initiators, polymerization inhibitors, bleed inhibitors, antiseptics, viscosity stabilizers, defoaming agents, surfactants, antistatic agents, mat agents, curling inhibitors, water-resistant additives, color fading suppressing agents such as a singlet oxygen quencher and other additives. When the ink receiving layer includes one or more such additives, deterioration of the ink may be suppressed.

As such additional components, one or more components selected from the components described in, for example, paragraphs [0101] to [0117] of JP-A No. 2005-14593 and paragraphs [0149] to [0155] of JP-A No. 2006-321776, may be used as appropriate.

Preferable examples of the crosslinking agent for crosslinking the water-soluble resin, especially for crosslinking the polyvinyl alcohol, include a boron compound. Specific examples of the boron compound include borax, boric acid, borates (such as orthoborate, $InBO_3$, $ScBO_3$, $YBO_3$, $LaBO_3$, $Mg_3(BO_3)_2$ and $Co_3(BO_3)_2$), diborates (such as $Mg_2B_2O_5$ and $Co_2B_2O_5$), metaborates (such as $LiBO_2$, $Ca(BO_2)_2$, $NaBO_2$, and $KBO_2$), tetraborates (such as $Na_2B_4O_7.10H_2O$), pentaborates (such as $KB_5O_8.4H_2O$ and $CsB_5O_5$) and hexaborates (such as $Ca_2B_6O_{11}.7H_2O$). Among these, from the viewpoint of rapidness of crosslinking reaction, borax, boric acid, and borates are preferable, and boric acid is particularly preferable.

The amount of the crosslinking agent to be used is preferably from 1% by mass to 50% by mass, and more preferably from 5% by mass to 40% by mass, with respect to the content of water-soluble resin in the ink receiving layer.

Mordant

The ink receiving layer preferably includes at least one mordant. When the ink receiving layer include at least one mordant, image bleeding over time can more effectively be suppressed, and water resistance can be further improved.

Examples of a preferable mordant include organic mordants such as a cationic polymer (cationic mordant) and inorganic mordants such as a water soluble metallic compound. Examples of a cationic mordant which can be preferably used include polymer mordants having, as a cationic functional group, a primary, secondary or tertiary amino group or a quarternary ammonium salt group. Examples of a cationic mordant which can be used also include cationic non-polymer mordant.

Preferable examples of the polymer mordant include homopolymers of a monomer having a primary, secondary or tertiary amino group or a salt thereof, or a quaternary ammonium salt group (which may also be referred to as a mordant monomer), and copolymers or condensation polymers of any one or more of the mordant monomers with at least one another monomer (which may also be referred to as a non-mordant monomer). The polymer mordant to be used may be in the form of a water-soluble polymer or water-dispersible latex particles.

Specific examples of the mordant monomer and the cationic polymer include those described in paragraphs [0024] to [0031] of JP-A No. 2008-246988. Specific examples of the inorganic mordant include those described in paragraphs [0130] to [0137] of JP-A No. 2008-246988.

When the mordant is added to the ink receiving layer, the amount of the mordant to be added is preferably from 0.01 $g/m^2$ to 5 $g/m^2$.

Water-Soluble Aluminum Compound

The ink receiving layer in the present invention preferably includes at least one water-soluble aluminum compound. When the ink receiving layer includes at least one water-soluble aluminum compound, image bleeding of a formed image over time can be more effectively suppressed, and the water resistance of the formed image can be improved more effectively.

Examples of the water-soluble aluminum compound include inorganic salts, known examples of which include aluminum chloride, hydrates of aluminum chloride, aluminum sulfate, hydrates of aluminum sulfate, and aluminum alum. Examples of the water-soluble aluminum compound further include basic polyaluminum hydroxide compounds, which are inorganic aluminum-containing cationic polymers. Among these water-soluble aluminum compounds, basic polyaluminum hydroxide compounds are preferable.

The basic polyaluminum hydroxide compound is a water-soluble polyaluminum hydroxide which stably includes a basic, high-molecular, multi-nuclear condensation ion such as $[Al_6(OH)_{15}]^{3+}$, $[Al_8(OH)_{20}]^{4+}$, $[Al_{13}(OH)_{34}]^{5+}$, or $[Al_{21}(OH)_{60}]^{3+}$, and of which main component is represented by the following formula 1, 2 or 3.

$$[Al_2(OH)_nCl_{(6-n)}]_m \quad 5<m<80,\ 1<n<5 \qquad \text{Formula 1}$$

$$[Al(OH)_3]_nAlCl_3 \quad 1<n<2 \qquad \text{Formula 2}$$

$$Al_n(OH)_mCl_{(3n-m)} \quad 0<m<3n,\ 5<m<8 \qquad \text{Formula 3}$$

These compounds are commercially available, and examples of the commercially available products include POLYALUMINUM CHLORIDE (PAC) (trade name) by Taki Chemical Co. Ltd. which is a water treatment agent, POLYALUMINUM HYDROXIDE (PAHO) (trade name) by Asada Kagaku Co. Ltd., PURACHEM WT (trade name) by Rikengreen Co. Ltd., ALUFINE 83 (trade name) by Taimei Chemicals Co. Ltd., and other products by other manufacturers for similar applications, and products of various grades are easily available. In the invention, such commercially available products may be used as they are. However, some commercially available products have unsuitably low pH. In a case in which a product having unsuitably low pH is employed, the pH thereof may be adjusted before use.

In the ink receiving layer in the present invention, the content of water-soluble aluminum compound is preferably from 0.1 mass % to 20 mass %, more preferably from 1 mass % to 8 mass %, and particularly preferably from 2 mass % to 4 mass %, with respect to the total solid content in the ink receiving layer. When the content of water-soluble aluminum compound is in the above ranges, glossiness, water resistance, gas resistance and light resistance can be further effectively improved.

Zirconium Compound

The ink receiving layer in the present invention preferably includes at least one zirconium compound. When the ink receiving layer includes at least one zirconium compound, effects in terms of improving water resistance can be more effectively obtained.

The zirconium compound for use in the present invention is not particularly limited, and various compounds may be used. Examples of the zirconium compound include zirconyl acetate, zirconyl chloride, zirconium oxychloride, zirconyl hydroxychloride, zirconyl nitrate, basic zirconium carbonate, zirconyl hydroxide, ammonium zirconyl carbonate, potassium zirconyl carbonate, zirconyl sulfate, and zirconyl fluoride. Zirconyl acetate is particularly preferable.

In the ink receiving layer, the content of zirconium compound is preferably from 0.05 mass % to 5.0 mass %, more preferably from 0.1 mass % to 3.0 mass %, and further more preferably from 0.5 mass % to 2.0 mass %, with respect to the total solid content in the ink receiving layer. When the content of the zirconium compound is in the above ranges, it is possible to further effectively improve water resistance without decreasing ink absorption properties.

In the present invention, a water-soluble multivalent metal compound other than the water-soluble aluminum compound and the zirconium compound may be used. Examples the water-soluble multivalent metal compound include a water-soluble salt of a metal or metals selected from calcium, barium, manganese, copper, cobalt, nickel, iron, zinc, chromium, magnesium, tungsten, or molybdenum.

More specific examples of the water-soluble multivalent metal compound include calcium acetate, calcium chloride, calcium formate, calcium sulfate, barium acetate, barium sulfate, barium phosphate, manganese chloride, manganese acetate, manganese formate dihydrate, manganese ammonium sulfate hexahydrate, copper (II) chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, iron (II) bromide, iron (II) chloride, iron (III) chloride, iron (II) sulfate, iron (III) sulfate, zinc bromide, zinc chloride, zinc nitrate hexahydrate, zinc sulfate, chromium acetate, chromium sulfate, magnesium sulfate, magnesium chloride hexahydrate, magnesium citrate nonahydrate, sodium phosphotungstate, sodium tungsten citrate, dodecatungstophosphoric acid n-hydrate, dodecatungstosilicic acid 26-hydrate, molybdenum chloride, and dodecamolybdophosphoric acid n-hydrate.

In order to provide the ink receiving layer with an ink receiving capacity which is sufficient to absorb all liquid droplets when subjected to ink-jet recording, the thickness of the ink receiving layer may be decided in relation to the porosity of the ink receiving layer. When, for example, the ink amount is 8 $nL/mm^2$ and the porosity of the ink receiving layer is 60%, the thickness of the ink receiving layer is preferably about 15 μm or more. In view of this, when the ink-jet recording medium is used for ink-jet recording, the thickness of the ink receiving layer is preferably from 10 μm to 50 μm.

The porosity of the ink receiving layer can be measured using a mercury porosimeter PORESIZER 9320-PC2 (trade name) manufactured by Shimadzu Corporation.

The ink receiving layer preferably has high transparency. As a guide of the transparency of the ink receiving layer, a haze value that is obtained by measuring the ink receiving layer formed on a transparent film support is preferably 30% or lower, more preferably 20% or lower. The haze value can be measured using a haze meter HGM-2DP (trade name) manufactured by Suga Test Instruments Co., Ltd.

The ink receiving layer in the present invention may have a single layer structure, or may include two or more sub-layers. When the ink receiving layer includes two or more sub-layers, each sub-layer in the ink-receiving layer has a structure different from that of a sub-layer adjacent thereto. Here, the "different structure" may refer to, for example, a difference in at least one of the kind or content of a component contained therein.

The method of forming the ink receiving layer in the present invention is not particularly limited. The ink receiving layer may be formed by using, for example, a common layer forming method such as a coating method.

Specifically, the ink receiving layer may be formed by applying a coating liquid for forming an ink receiving layer, which includes inorganic particles and a water-soluble resin and optionally further includes one or more other components, onto one side of the support (a side opposite to a side at which the back layer, if any, is disposed), and drying the resultant coating layer.

The method of forming the ink receiving layer of the ink jet recording medium of the present invention may be, for example, a production method that includes at least:

preparing a dispersion liquid by dispersing inorganic particles and a zirconium compound by counter-collision using a high pressure disperser or by passing the mixture through an orifice;

preparing an ink receiving layer forming liquid by adding a cationic polymer, a polyvinyl alcohol and a crosslinking agent to the thus obtained dispersion liquid; and forming a coating layer by applying a coating liquid, which has been obtained by inline-mixing a water-soluble aluminum compound into the ink receiving layer forming liquid, onto the support.

In regard to the specifics of the method of preparing the dispersion liquid, the method of preparing the ink receiving layer forming liquid, and the method of preparing the coating liquid, the methods described in, for example, paragraphs [0098] to [0117] of JP-A 2007-223119 (which is incorporated by reference herein) can preferably be applied in the present invention.

The application of the ink receiving layer forming liquid may be performed according to a known coating method using, for example, an extrusion die coater, an air doctor coater, a blade coater, a rod coater, a knife coater, a squeeze coater, a reverse roll coater, or a bar coater.

In the present invention, when the ink receiving layer is the outermost layer, the coefficient of static friction between (the surface of) the ink receiving layer and a surface of the ink-jet recording medium at a side that is opposite to a side at which the ink receiving layer is disposed is preferably higher than 0.8, from the viewpoint of transportability of the ink-jet recording medium.

The coefficient of static friction between the surface of the ink receiving layer and the surface of the ink jet recording medium at the side opposite to the ink receiving layer side is preferably from 0.8 to 1.5, and more preferably from 0.8 to 1.2.

The coefficient of static friction between the surface of the ink receiving layer and the surface of the ink jet recording medium at the side that is opposite to the side at which the ink receiving layer is disposed can be measured using two sheets of the ink jet recording medium and a test apparatus TENSILON (trade name) manufactured by A & D Company Limited, in accordance with the J.TAPPI paper pulp test method No. 30-79. The J.TAPPI paper pulp test method No. 30-79 is incorporated by reference herein. More specifically, one of the sheets (first sheet) is contacted with the other sheet (second sheet) such that the ink receiving layer of the first sheet contacts a surface of the second sheet at a side opposite to the ink receiving layer.

EXAMPLES

In the following, the present invention is described in further detail with reference to examples. However, the examples should not be construed as limiting the invention. The terms "part" and "%" are based on mass, unless indicated otherwise.

Example 1

Preparation of Support 50 parts of LBKP obtained from acacia and 50 parts of LBKP obtained from aspen were respectively beaten using a disc refiner to give a Canadian freeness of 300 mL, and thus a pulp slurry was prepared.

Subsequently, to the pulp slurry obtained as described above, 1.3% of cationic starch (trade name: CAT 0304L, manufactured by Nippon NSC, Ltd.), 0.15% of anionic polyacrylamide (trade name: POLYACRON ST-13, manufactured by Seiko PMC Corporation), 0.29% of an alkyl ketene dimer (trade name: SIZEPINE K, manufactured by Arakawa Chemical Industries, Ltd.), 0.29% of epoxidated behenamide, and 0.32% of polyamide-polyamine-epichlorohydrin (trade name: ARAFIX 100, manufactured by Arakawa Chemical Industries, Ltd.) were added, and thereafter 0.12% of a defoaming agent was added thereto. The percentages above are percentages relative to the pulp.

The pulp slurry prepared as described above was subjected to paper making using a fourdrinier paper machine. The felt face of the web was pressed against a drum dry cylinder with a dryer canvas interposed therebetween at a tensile strength of the dryer canvas set at 1.6 kg/cm, thereby drying the web. Then, polyvinyl alcohol (trade name: KL-118, manufactured by Kuraray Co., Ltd.) was applied both sides of the base paper in an amount of 1 g/m$^2$ for each side, by size press, and then dried, followed by calender treatment. The base paper was formed to have a basis weight of 157 g/m$^2$, and thus a base paper having a thickness of 157 μm was obtained.

The wire face side (back side) of the obtained base paper was subjected to corona discharge treatment. Thereafter, polyethylene was coated on the wire face by melt extrusion at a temperature of 320° C. using a melt extruder such that a high density polyethylene having a density of 0.95 g/cm$^3$ and a low density polyethylene having a density of 0.92 g/cm$^3$ were blended at a mass ratio (high density polyethylene/low density polyethylene) of 80%/20% and the mixture was applied in an amount of 20 g/m$^2$, and the coated layer was pressed against a chill roll so as to obtain a surface roughness as shown in Table 1, whereby a polyethylene resin layer having a desired surface roughness was formed. Hereinafter the side having the polyolefin layer is sometimes referred to as "back side".

Back Layer Formation

In the presence of a reactive emulsifying agent (trade name: ADEKA REASOAP SE-10N, manufactured by Asahi Denka Kogyo Co., Ltd.), 62 parts of styrene, which is an aromatic ethylenically unsaturated monomer, 5 parts of glycidyl methacrylate, which is an ethylenically unsaturated monomer having an epoxy group, 3 parts of acrylic acid, which is an ethylenically unsaturated carboxylic acid monomer, and 30 parts of 2-ethylhexyl acrylate, which is an additional ethylenically unsaturated monomer, were subjected to emulsion polymerization to obtain an aqueous dispersion of a styrene-acrylic ester copolymer, which is referred to as a component A.

An isoprene-styrene-isoprene ABA block copolymer (isoprene/styrene/isoprene=40/20/40 (by mole ratio), weight average molecular weight: 7500) was sulfonated, and was neutralized using sodium hydroxide to obtain a water-insoluble resin dispersion including a sodium salt, which is referred to as a component B.

Using 14 parts of the component A (aqueous dispersion) and 8 parts of the component B (water-insoluble resin dispersion), a water dispersion having a solid content of 24% was prepared. 10 parts of the thus obtained water dispersion and 24 parts of colloidal silica (trade name: SNOWTEX O, manufactured by Nissan Chemical Industries Ltd, 20% aqueous solution) were mixed to prepare a coating liquid for forming a back layer.

The polyolefin resin layer formed on the back side was subjected to corona discharge treatment, and then was coated with the coating liquid for forming a back layer by an extrusion die coater so as to have a solid coating amount of 0.2 g/m$^2$, followed by drying at a temperature of 70° C., whereby a back layer was formed.

Subsequently, the side that is opposite to the side on which the back layer was formed (hereinafter sometimes referred to as "front side") was subjected to corona discharge treatment, and then, polyethylene having a density of 0.93 g/cm$^3$ and including 10% by mass of titanium oxide was coated thereon in an amount of 24 g/m$^2$ by melt extrusion at a temperature of 320° C. using a melt extruder, whereby a support having a polyethylene resin layer disposed on both sides, and also having a back layer on the back side was formed.

Preparation of Ink Receiving Layer Forming Liquid A

According to "Formulation of silica dispersion liquid A" as described below, fumed silica particles were mixed with a liquid prepared by mixing dimethyldiallylammonium chloride polymer (trade name: SHALLOL DC-902P, manufactured by DAIICHI KOGYO SEIYAKU CO., LTD) with ion-exchange water. Then, zyrconyl acetate was further added to the resulting mixture. The resultant slurry was further subjected to dispersing treatment using an ULTIMIZER (trade name) manufactured by Sugino Machine Limited at a pressure of 170 MPa, whereby a silica dispersion liquid A in which silica particles having a median diameter (an average particle diameter) of 120 nm were dispersed was prepared.

According to "Formulation of ink receiving layer forming liquid A" as described below, ion-exchange water, a 7.5% boric acid solution, dimethylamine-epichlorohydrin-polyalkylenepolyamine polycondensate, a polyvinyl alcohol solution, and a cation-modified polyurethane (a cationic polymer) were sequentially added to the above silica dispersion liquid, followed by mixing, whereby an ink receiving layer forming liquid A was prepared.

Formulation of Silica Dispersion Liquid A

| | |
|---|---|
| (1) Fumed silica particles (AEROSIL 300SF75, manufactured by Nippon Aerosil Co., Ltd.) | 15.0 parts |
| (2) Ion-exchange water | 82.9 parts |
| (3) Dimethyldiallylammonium chloride polymer (SHALLOL DC-902P (trade name), manufactured by Dai-ichi Kogyo Seiyaku Co., Ltd., 51.5% solution) | 1.31 parts |

-continued

| | |
|---|---|
| (4) Zirconyl acetate (ZIRCOSOL ZA-30 (trade name), manufactured by Daiichi Kigenso Kagaku Kogyo Co., Ltd., 50% solution) | 0.81 parts |

Formulation of Ink Receiving Layer Forming Liquid A

| | |
|---|---|
| (1) Silica dispersion liquid A | 59.5 parts |
| (2) Ion-exchange water | 7.8 parts |
| (3) 7.5% boric acid solution (crosslinking agent) | 4.4 parts |
| (4) Dimethylamine-epichlorohydrin-polyalkylenepolyamine polycondensate (50% solution), (trade name: SC-505, manufactured by HYMO Co., Ltd.) | 0.1 parts |
| (5) Polyvinyl alcohol solution described below | 26.0 parts |
| (6) Cation-modified polyurethane (trade name, SUPERFLEX 650-5, manufactured by Dai-Ichi Kogyo Seiyaku Co., Ltd., 25% solution) | 2.2 parts |

Formulation of Polyvinyl Alcohol Solution

| | |
|---|---|
| (1) Polyvinyl alcohol (trade name: JM-23, manufactured by JAPAN VAM & POVAL Co., Ltd., having a saponification degree of 96.8 mol % and a polymerization degree of 2400) | 6.96 parts |
| (2) Polyoxyethylene lauryl ether (surfactant; trade name: EMULGEN 109P, manufactured by Kao Corporation) | 0.23 parts |
| (3) Diethylene glycol monobutyl ether (trade name: BUTYCENOL 20P, manufactured by Kyowa Hakko Chemical Co., Ltd.) | 2.12 parts |
| (4) Ion-exchange water | 90.69 parts |

Preparation of Ink-Jet Recording Medium

The front face of the obtained support was subjected to corona discharge treatment. Thereafter, the ink receiving layer forming liquid A described above and the in-line liquid 1 as described below were in-line blended such that the coating amount of the ink receiving layer forming liquid A was 183 g/m$^2$ and the coating amount of the in-line liquid 1 was 11.4 g/m$^2$, and the blended liquid was applied to the front surface using an extrusion die coater, thereby forming a coating layer. Thereafter, the resultant coating layer was dried at 80° C. using a hot air dryer (at an air flow rate of from 3 msec to 8 msec) until the solid content of the coating layer become 20%. This coating layer showed constant-rate drying during this drying process. Before the coating layer starts falling-rate drying, the support was dipped in a basic solution having the following formulation (pH: 7.8) for three seconds, whereby the basic liquid in an amount of 13 g/m$^2$ adhered to the coating layer. Further, the resultant coating layer was dried at 65° C. for 10 minutes (curing process). An ink jet recording medium 1 was thus prepared which had an ink receiving layer having a dry thickness of 32 μm, and which further had a back layer on the back side (opposite to the ink receiving layer).

Formulation of In-Line Liquid 1

| | |
|---|---|
| (1) Polyaluminum chloride aqueous solution (trade name: ALFINE 83, manufactured by Taimei Chemical Co., Ltd., having a basicity of 83%) | 20 parts |
| (2) Ion-exchange water | 80 parts |

Formulation of Basic Liquid

| | |
|---|---|
| (1) Boric acid | 0.65 parts |
| (2) Ammonium carbonate (first class grade) (manufactured by Kanto Chemical Co., Ltd.) | 3.5 parts |

-continued

| | |
|---|---|
| (3) Ion exchange water | 63.3 parts |
| (4) Polyoxyethylene lauryl ether (surfactant; trade name: EMULGEN 109P, manufactured by Kao Corporation. 2% aqueous solution) | 30.0 parts |

The Ra of the ink jet recording medium 1 measured with a cut-off value of 0.8 mm was measured using a surface profile measurement apparatus NANOMETRO 110F (trade name; manufactured by Kuroda Precision Industries Ltd.)

The measurement conditions were as follows.

Scanning direction: machine direction (MD) of sample

Measurement length: 50 mm in X direction and 30 mm in Y direction

Measurement pitch: 0.1 mm in X direction and 1.0 mm in Y direction

Scanning velocity: 30 mm/sec.

The Sra of the ink-jet recording medium 1 measured with a cut-off value of from 1 μm to 25 μm was measured using an apparatus NEW VIEW 5022 (trade name; manufactured by Zygo).

The coefficient of static friction of the ink-jet recording medium 1 was measured as follows. Two A4-sized sheets of the recording medium 1 were superposed one on the other such that the front face of one sheet and the back face of the other sheet were contacted with each other, and coefficient of static friction was measured in accordance with the J. TAPPI paper pulp test method No. 30-79, using a test apparatus TENSILON (trade name) manufactured by A & D Company Limited.

Examples 2 to 4 and Comparative Examples 1 to 3

Ink jet recording media of Examples 2 to 4 and Comparative Examples 1 to 3 were prepared in the same manner as in Example 1, except that the polyolefine resin layer formed on the back side was processed to have Ra with a cut-off value of 0.8 mm and Sra with a cut off value of from 1 μm to 25 μm as shown in Table 1.

Example 5 and Comparative Example 4

An ink jet recording medium of Example 5 was prepared in the same manner as in Example 1, except that the back layer was not formed on the back side of the support. An ink jet recording medium of Comparative Example 4 was prepared in the same manner as in Comparative Example 1, except that the back layer was not formed on the back side of the support.

Evaluations

The thus obtained ink-jet recording media were evaluated as follows. The Evaluation results are shown in the following Table 1.

The below-described method of evaluating the unevenness due to fogging is an evaluation method that simulates an example of a state in which the ink receiving layer and the back layer are rubbed against each other during slitting using a surface winding apparatus.

Evaluation of Unevenness Due to Fogging Caused by Polyolefine Resin Adhesion (Resulting from Scratching)

Two 10 cm square sheets of the ink jet recording medium obtained as described above were superposed one on the other such that a side of one sheet on which the ink receiving layer is disposed and a side of the other sheet on which the back layer is disposed were contacted with each other. These two sheets were rubbed against each other for 20 reciprocal strokes for a length of 160 μm under application of an average pressure of 0.14 MPa, whereby an evaluation sample was obtained.

Using an ink-jet printer DL 410 (trade name, manufactured by FUJIFILM CORPORATION) in which a genuine manufacturer's ink was loaded, a black solid image was printed on the ink receiving layer of which the surface had been rubbed against the back layer of the other sheet as described above. The black solid image formed was observed using a microscope, and evaluated according to the following evaluation criteria. The evaluation results are shown in Table 1.

Evaluation Criteria

A: The number of scratches of 100 μm or more observed per 6 $mm^2$ is fewer than 10. Unevenness due to fogging is hardly observed by visual observation.

B: The number of scratches of 100 μm or more observed per 6 $mm^2$ is from 10 to fewer than 20. Unevenness due to fogging is slightly observed by visual observation.

C: The number of scratches of 100 μm or more observed per 6 $mm^2$ is from 20 to fewer than 50. Unevenness due to fogging is observed by visual observation, but the degree of the unevenness is at a practically unproblematic level.

D: The number of scratches of 100 μm or more observed per 6 $mm^2$ is 50 or more. Severe unevenness due to fogging is observed by visual observation, and the degree of the unevenness is at a practically problematic level.

Evaluation of Unevenness Due to Fogging Caused by Pressure Application

Two 3 cm square sheets of the ink jet recording medium obtained as described above were superposed one on the other such that a side of one sheet at which the ink receiving layer is disposed and a side of the other sheet at which the back layer is disposed were contacted with each other. A pressure at an average of 0.2 MPa was applied to the stacked sheets for 60 minuets, whereby an evaluation sample was obtained.

Using an ink-jet printer DL 410 (trade name, manufactured by FUJIFILM CORPORATION) in which a genuine manufacturer's ink was loaded, a black solid image was printed on the ink receiving layer of which the surface had been rubbed against the back layer of the other sheet as described above. The black solid image formed was observed using a microscope, and evaluated according to the following evaluation criteria. The evaluation results are shown in Table 1.

Evaluation Criteria

A: The number of pressure marks of 15 μm or more per 25 $cm^2$, which represent unevenness due to fogging, is fewer than 10. Unevenness due to fogging is hardly observed by visual observation.

B: The number of pressure marks of 15 μm or more per 25 $cm^2$, which represent unevenness due to fogging, is from 10 to fewer than 50. Unevenness due to fogging is slightly observed by visual observation.

C: The number of pressure marks of 15 μm or more per 25 $cm^2$, which represent unevenness due to fogging, is 50 or more. Severe unevenness due to fogging is observed by visual observation, and the degree of the unevenness is at a practically problematic level.

Evaluation of Anti-Blocking Properties

Two A4-sized sheets of the ink-jet recording medium obtained as described above were superposed one on the other, and a pressure of 20 $g/cm^2$ was applied thereto. The stacked sheets in this state were left in an environment of a temperature of 30° C. and a relative humidity of 80% RH for one day, and the degree of blocking was observed and evaluated according to the following criteria. The evaluation results are shown in the following Table 1.

Evaluation Criteria

A: Blocking is not observed

B: Blocking is slightly observed, and the degree of the blocking is at a practically unproblematic level.

C: Blocking is observed, and the degree of the blocking is at a practically problematic level.

TABLE 1

| | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|
| Ra | 0.85 | 0.95 | 0.71 | 0.68 | 0.86 | 0.72 | 0.36 | 1.50 | 0.74 |
| Sra | 0.07 | 0.06 | 0.27 | 0.22 | 0.08 | 0.38 | 0.06 | 0.06 | 0.40 |
| Static friction coefficient | 0.85 | 0.83 | 0.84 | 0.86 | 0.82 | 0.84 | 0.92 | 0.84 | 0.72 |
| Unevenness due to fogging caused by scratching | A | A | A | A | A | D | A | D | D |
| Unevenness due to fogging caused by pressure application | A | A | B | B | A | C | A | C | D |
| Anti-Blocking properties | A | A | A | A | A | A | C | A | B |

As is shown in Table 1, it is understood that, when using the ink jet recording medium according to the present invention, generation of unevenness due to fogging caused by scratching or due to pressure application is suppressed when the inkjet recording medium is processed using a surface winding apparatus, and anti-blocking properties are also improved.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. An ink-jet recording medium comprising:

a support including a base paper, a first polyolefin resin layer disposed on one side of the base paper, and a second polyolefin resin layer disposed on the other side of the base paper, and an ink receiving layer including inorganic particles and a water-soluble resin, the ink receiving layer being disposed on one side of the support, wherein a first surface of the support at a side that is opposite to a side at which the ink receiving layer is disposed has a centerline average roughness (Ra) of from 0.5 μm to 1.0 μm when measured in accordance with JIS-B-0601 with a cutoff value of 0.8 mm, and an average surface roughness (Sra) of 0.3 μm or less when a cutoff value is from 1 μm to 25 μm.

2. The ink jet recording medium according to claim 1, wherein a coefficient of static friction between the ink receiving layer and a surface of the ink jet recording medium at a side opposite to a side at which the ink receiving layer is disposed is 0.8 or higher.

3. The ink jet recording medium according to claim 1, wherein the first surface of the support has a centerline average roughness (Ra) of from 0.6 μm to 0.9 μm when measured in accordance with JIS-B-0601 with a cutoff value of 0.8 mm.

4. The ink jet recording medium according to claim 1, wherein the first surface of the support has an average surface roughness (Sra) of 0.25 μm or less when a cutoff value is from 1 μm to 25 μm.

5. The ink jet recording medium according to claim 1, wherein the first polyolefin resin layer is disposed on the same side of the base paper as the ink receiving layer, and an average surface roughness (Sra) of the polyolefin resin layer is from 0.02 μm to 0.20 μm at a frequency of from 0.2 mm to 0.3 mm.

6. The ink jet recording according to claim 2, wherein a coefficient of static friction between the ink receiving layer and a surface of the ink-jet recording medium at a side opposite to a side at which the ink receiving layer is disposed is from 0.8 to 1.5.

7. The ink jet recording according to claim 2, wherein a coefficient of static friction between the ink receiving layer and a surface of the inkjet recording medium at a side opposite to a side at which the ink receiving layer is disposed is from 0.8 to 1.2.

8. The ink jet recording according to claim 1, further comprising a back layer that comprises a binder resin on the first surface of the support.

9. The ink jet recording according to claim 8, wherein the back layer further comprises an organic pigment.

10. The ink jet recording according to claim 1, wherein the first surface of the support has been pressed against a chill roll.

11. An ink-jet recording medium comprising a support and an ink receiving layer, wherein a coefficient of static friction between the ink receiving layer and a surface of the ink-jet recording medium at a side opposite to a side at which the ink receiving layer is disposed is 0.8 or greater.

* * * * *